United States Patent [19]

Renders et al.

[11] 4,444,730

[45] Apr. 24, 1984

[54] DETERGENT DISPENSER

[75] Inventors: Gerard Renders, Jupille; Jean-Pierre Denis, Thimister; Lucien Gryglewicz, ANS, all of Belgium

[73] Assignee: Colgate-Palmolive Company, New York, N.Y.

[21] Appl. No.: 385,639

[22] Filed: Jun. 7, 1982

[51] Int. Cl.[3] ..... B01D 11/02

[52] U.S. Cl. ..... 422/264; 134/93; 222/182; 222/189; 422/277

[58] Field of Search ..... 422/261, 263, 264, 265, 422/266, 275, 277, 279, 264 B; 134/93; 4/227, 228, 231; 222/52, 185, 189, 182; 210/206

[56] References Cited

U.S. PATENT DOCUMENTS

| | | | |
|---|---|---|---|
| 87,119 | 2/1869 | Snyder | 422/275 X |
| 693,749 | 2/1902 | Smith | 422/275 |
| 2,014,037 | 9/1935 | Burkett et al. | 422/279 |
| 2,287,339 | 6/1942 | Balcunas | 422/266 |
| 2,762,527 | 9/1956 | Manley | 422/266 |
| 3,390,402 | 6/1968 | Goerg | 422/279 |
| 3,850,344 | 11/1974 | Burge et al. | 422/266 X |
| 4,020,865 | 5/1977 | Moffat et al. | 422/264 B X |
| 4,063,663 | 12/1977 | Larson et al. | 222/52 |

FOREIGN PATENT DOCUMENTS

| | | | |
|---|---|---|---|
| 44034 | 1/1982 | European Pat. Off. | 4/228 |

*Primary Examiner*—Richard L. Chiesa

*Attorney, Agent, or Firm*—Herbert S. Sylvester; Murray M. Grill; John A. Stemwedel

[57] ABSTRACT

Detergent dispenser for providing water-added, concentrated detergent solutions, particularly for replenishing the detergent reservoir of an automatic washing machine, comprising a container equipped internally with a horizontally disposed perforated plate for receiving detergent the plate dividing the container into an upper detergent retaining zone and a lower fluid reservoir zone. In operation, water is continually admitted to the reservoir zone through an inlet port and rises through the plate and detergent mass, thereafter exiting as a concentrated detergent solution via a discharge port positioned above the detergent retaining zone.

18 Claims, 5 Drawing Figures

DETERGENT DISPENSER

BACKGROUND OF THE INVENTION

1. Field of the Invention

This invention relates generally to dispensers for providing a solution form of detergent and particularly to such a dispenser advantageously adapted for supplying a concentrated detergent solution to the detergent reservior portion of an automatic washing machine.

2. Description of the Prior Art

Automatic washing machines used commercially consume relatively large amounts of detergent and thus often require detergent replenishment. To minimize personal attendance, a variety of detergent dispensers are provided adapted for automatic and/or manual operation. When activated, the dispenser supplies a concentrated detergent solution to the detergent reservior portion of an automated washing machine in fluid flow contact with the discharge port of raid dispenser. Automatic means are preferably provided for both activating and de-activating the detergent replenishment process.

Exemplary prior art devices function as follows. Upon activation, a relatively high pressure water spray is caused to impinge upon a detergent mass retained upon a screen member positioned within the dispenser. The so-affected detergent portion is solubilized and is fed to external piping for transport to the washing machine indicated detergent demand. This type of dispenser is described, for example, in U.S. Pat. No. 4,063,663. In another type of dispenser, the detergent mass is normally maintained in solution or slurry form. In response to detergent demand, water is fed to the dispenser causing the slurry to overflow a standpipe member connected flow path-wise to the washing machine detergent reservior. The spray process requires relatively high pressure and may be costly due to increased pumping requirments. Morover, saturated discharge detergent solutions are not assured due to inefficient and highly abbreviated water-detergent mass contacting. The problem is particularly acute with less soluble detergents. Embodiments based upon maintaining the detergent in slurry form produce non-uniform discharge solutions since the slurry constantly undergoes dilution as inlet water is fed thereto.

In accordance with the invention, a detergent dispenser for such use is provided wherein the foregoing problems are eliminated or at least mitigated to a substantial extent said dispenser being effectively operable with difficulty soluble detergents and at extremely low inlet water pressures yet providing highly concentrated, more uniform product detergent solutions. Structural features according to preferred embodiments enable minimization of caking and risk to personal safety due to splashing. These advantagwes are obtained whether the detergent charged to the disperser be in powder, flake, granule, liquid, pellet or paste (including thixotropic species) form.

Thus, the invention provides a detergent dispenser container for producing water-added detergent solutions comprising top, bottom and connecting sidewall portions, said top portion being pivotally mounted to said sidewall portion for movement to open and closed positions, a support member disposed substantially horizontally within said container for receiving detergent and having a plurality of apertures for distributing an aqueous medium upwardly of said member, said support member in combination with said sidewall portion defining a detergent retaining zone thereabove, water inlet means positioned in initiate water flow upwardly through said apertures, outlet means positioned above said detergent retaining zone for discharging aqueous, solubilized detergent from said container and adapted to removably engage conduct means for external transport of said discharged liquid, switch control means responsive to movement of said top portion for blocking water flow to said container when said top portion is removed from a fully closed position and means for attaching said container to an external supporting surface.

The invention is described by reference to accompanying drawing wherein like reference numerals designate similar parts throughout the views and wherein:

DETAILED DESCRIPTION OF THE INVENTION

Figure 1:
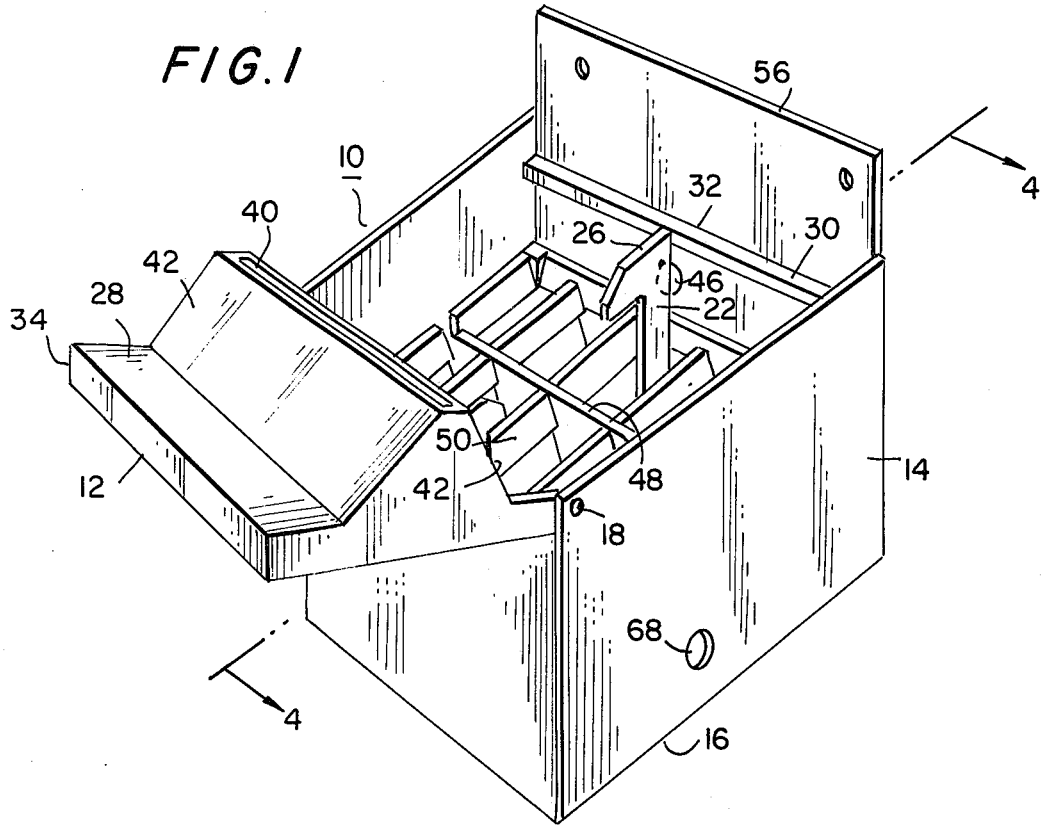
FIG. 1 is a view in perspective illustrating a container of the invention in open cover position.
Figure 3:
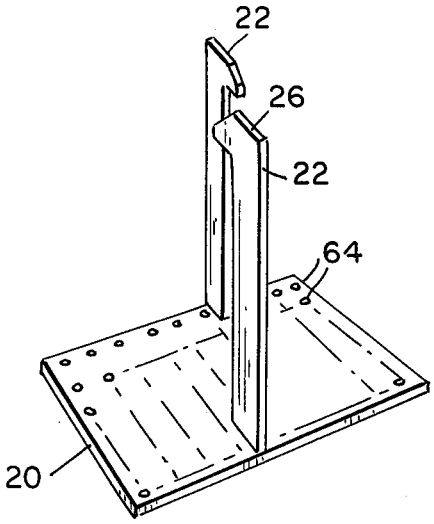
FIG. 3 is a perspective view illustrating a perforated plate equipped with removal handle means in accordance with an embodiment of the invention.
Figure 5:
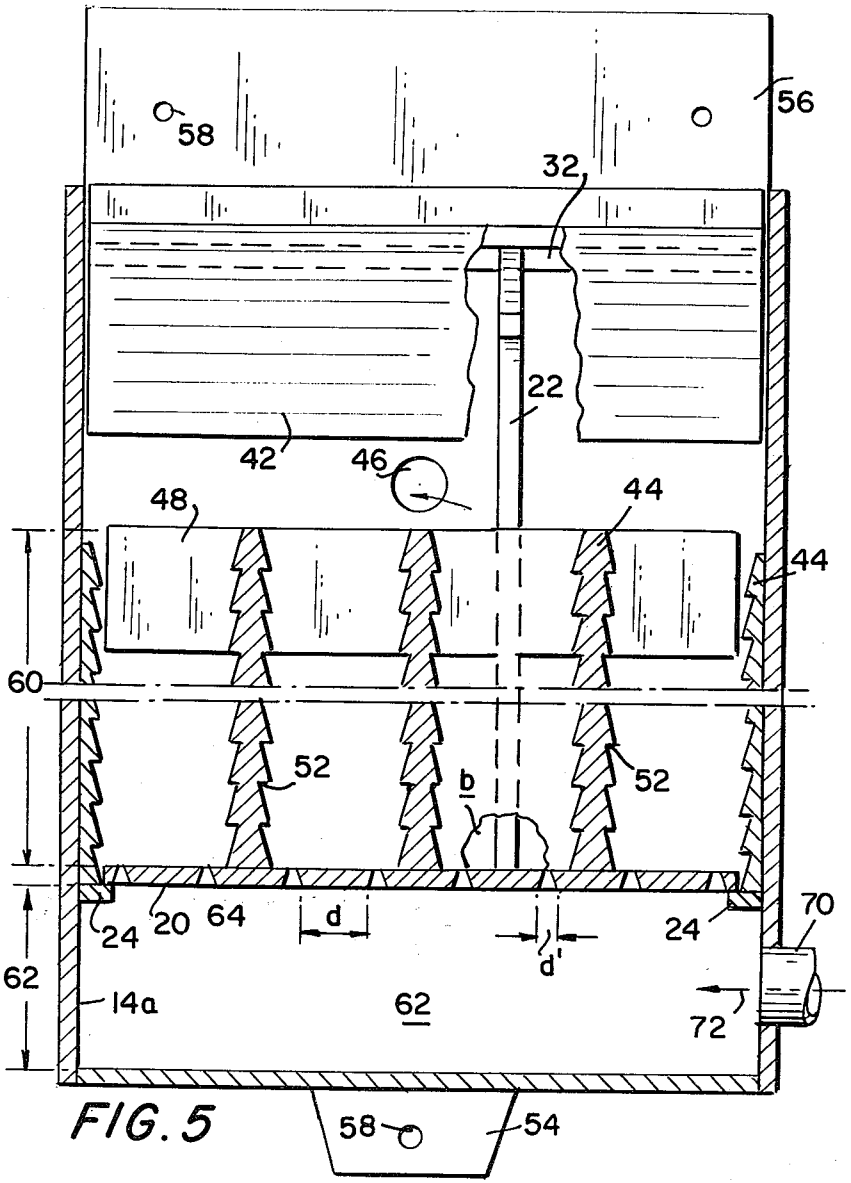
FIG. 5 is a sectional view taken along the line 5—5 of FIG. 4.
Figure 4:
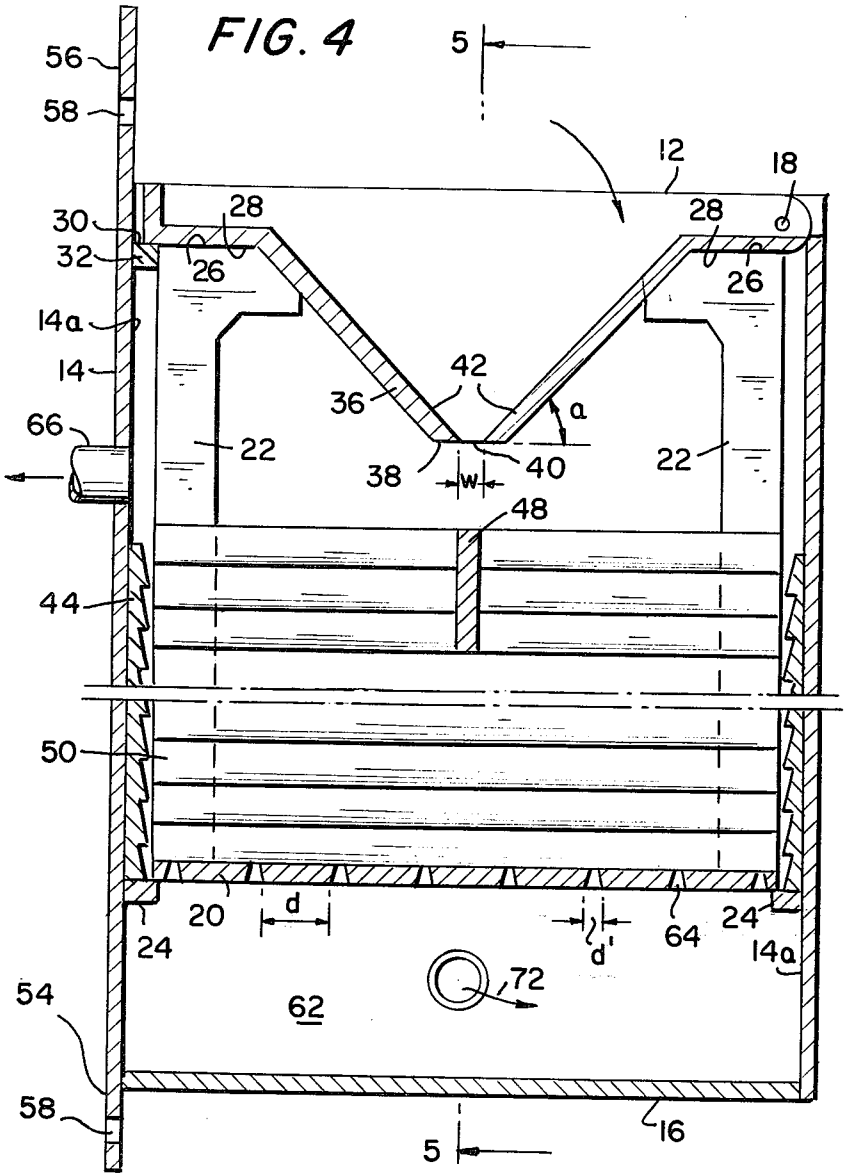
FIG. 4 is a sectional view taken along the line 4—4 in FIG. 1 with cover closed.

In FIG. 1, a detergent dispensing container, generally designated 10 comprises top (cover), sidewall and bottom portions 12, 14, and 16 respectively, the cover 12 being pivotally mounted to the sidewall 14 at 18 for pivotal motion to open and closed positions as illustrated in FIGS. 1 and 4 respectively. A perforated plate 20 (FIG. 3) equipped with opposed, upwardly extending arms 22 supported by plate 20 (see also FIG. 5, section "b" partly broken away) for facilitating removal of the plate 20 from the container 10 when necessary, is disposed substantially horizontally within the container as illustrated in FIGS. 4 and 5 and is peripherally supported by a flange member 24. The latter is integral with the inner surface 14*a* of sidewall 14. Arms 22 are configured at their upper terminuses to facilitate hand gripping thereof and to provide additional support means for the cover 12 via surfaces 26, which engage mating surfaces 28 of the cover 12 when the latter is in closed position as illustrated in FIG. 4. As further illustrated in FIG. 4, the surface 26 of the arm 22 is flush with the surface 30 of the supporting strut 32, the latter integral with the inner surface 14*a* of the sidewall 14. According to this construction, the sidewall 14, the strut 32 and the arm 22 combine to provide support for the cover 12 in the closed position.

In accordance with a preferred embodiment, the cover 12 is configured to provide a peripheral ledge portion 34 integral with a downwardly convergent central portion, generally indicated at 36, truncated as illustrated at 38 to provide a slit type opening 40 which communicates with the internal portion of the container 10. Convergent sidewalls 42 are preferably angled at about 25°14 75°, more preferably 35°–55° with respect to the horizontal as illustrated at "a" in FIG. 4. According to this construction, the cover 12 provides effective hopper or trough means enabling detergent to be charged to the container 10 while the cover 12 is in closed position. This construction has the function advantage in that it tends to minimize caking. For commercial applications, the cover 12 can be sized to accommodate i.e., "trough" from about 50 to 1000 cc of detergent; in such instances, the width "w" of the slit 40 (FIG. 4) may range from about 3 to 20 mm. and preferably from about 4–8 mm.

Figure 2:
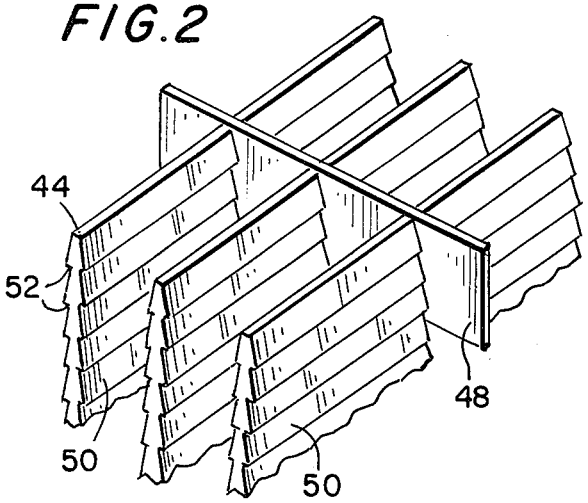
FIG. 2 is a perspective view shown partly broken away illustrating a baffle arrangement in accordance with the invention.

Vertically disposed baffles 44 may optionally be provided (FIG. 2 and 5) supported by the perforated plate 20 and extending upwardly to a point just below the discharge or outlet port 46. As shown in FIGS. 4 and 5, the baffles 44 may be integral with the inner surface 14*a* of the sidewall 14. A transverse member 48 is preferably included to physically stabilize the positioning of the baffles. As shown in FIG. 2, the surfaces 50 of the baffles 44 have a louver-like appearance, this being conducive to efficient and intimate contacting of water and detergent since the corner portions 52 presented by such construction tend to create turbulence. Such construction further tends to reduce caking. The number of baffles employed is not critical; generally, from 3 to 6 baffles suffice and are positioned to provide from 2 to 5 co-equal sections for receiving detergent.

Flange plates 54 and 56 provided with openings 58 enable attachment of the container 10 to an external supporting surface which may be the washing machine itself or a structure closely adjacent thereto.

The perforated plate 20 in conjunction with the sidewall 14 (which includes the flange 24) volume of the container 10 into a detergent retaining zone 60 thereabove and a liquid reservoir portion 62 therebelow. In the embodiment illustrated, the uppermost boundary of the detergent retaining zone is coterminous with a horizontal plane taken through the topmost portions of the baffles 44, while the bottom portion 16 defines the lowermost boundary of the fluid reservoir portion. Whether or not baffles are present, the upper boundary of the detergent retaining zone 60 should be distanced vertically from the outlet port 46 by a value corresponding to about 2 to 20% of the entire vertical extent of said detergent retaining zone. Detergent "zone" as used herein is not necessarily coextenisve in significance with the actual amount of detergent present at a given point in time. Since detergent is constantly being depleted in use, its total mass may be significantly less than that necessary to occupy the total volume included by the detergent retaining zone.

The vertical distance separating the perforated plate 20 and the bottom portion 16 will generally be from about 20 to 100% of the entire vertical extent of the detergent retaining zone 60.

The perforated plate 20, as illustrated in FIG. 3, is provided with a plurality of apertures 64 which may be configured according to a variety of patterns, preferably symmetrical, to assume uniform wetting of the detergent mass upon activation of the container apparatus. As shown in FIG. 3, the apertures 64 are arranged in parallel along substantially peripendicular axes.

Adjacent apertures are preferably separated by about 10 to 40 mm as indicated at "d" in FIGS. 4 and 5. Generally, the apertures are circular in shape and have an average diameter (d, in FIGS. 4 and 5) of about 0.5 to 2.75 mm.

The container 10 can be activated either manually or automatically. In operation, the output port 46 would be in liquid flow communication via suitable conduit means, shown partly broken away in FIG. 4 as 66, with the detergent reservoir of a washing machine. Assuming the latter to require detergent solution replenishment, water flow to the container 10, previously charged with the necessary amount of detergent, is initiated by opening one or more valves in the external water supply lines (not shown). Water enters fluid reservoir zone 62 through an inlet port 68 via a conduit 70, shown partly broken away in FIG. 5, inlet flow direction also being indicated by the directional arrow 72 in FIGS. 4 and 5. Eventually, inlet water fills reservoir the zone 62, passes upwardly through the apertures 64 of the perforated plate 20 and wets the entire mass of detergent provided in the detergent retaining zone 60. In the preferred embodiment shown in FIG. 5, the location of the water inlet 68 is in the sidewall 14 rather than in the bottom portion 16 which serves to evenly distribute the water flow without surging through the apertures of the perforated plate 20. As the water percolates through the detergent mass, it becomes increasingly more detergent-rich i.e., more concentrated, and approaches if not achieves a saturated state due to the continual "solvent extraction" of detergent by the up-coursing water mass. Eventually, the water overflows the detergent mass forming a supernatant layer which is discharged to external piping through the output port 46. The container 10 is positioned to enable gravity feed of the discharge solution to the detergent reservoir of the washing machine being replenished. When demand is satisfied, the process is terminated by merely closing the water supply line to the inlet port 68.

As will further be appreciated, the water now present in the container 10 will dissolve some amount of dissolved detergent. No detergent is lost, however, since this water is locked into the system and is available for useful purposes when the process is next activated.

The process can be effected automatically utilizing sensing and signal means well known in the art for such use. Such systems are described, for example in U.S. Pat. No. 4,063,663 and publications cited therein, the relevant teachings of which as regards automated procedures are incorporated herein by reference. For example, as the detergent solution within the reservoir portion of the washing machine is diluted during washing or rinsing operations, the conductivity of the detergent solution will drop. When the conductivity value drops below a predetermined threshold level, a conductivity cell communicates this information by means of signal flow paths designed in conjunction with an appropriate control module. The latter produces an output signal at its signal output for energizing a solenoid valve positioned in the water supply line to the inlet port 68. In response to such signal, the solenoid valve opens, allowing water to flow through the inlet port 68 to the fluid reservoir zone 62. The detergent dissolution process proceeds in the manner previously described. When a sufficient amount of concentrated detergent solution has been added to the reservoir portion of the associated washing machine so as to re-establish the requisite, predetermined conductivity level therein, the conductivity cell communicates such information to the said electronic control module which removes the enabling output signal from its signal output terminal thus disabling, i.e., closing the solenoid valve.

By virtue of the cover construction in accordance with a prepared embodiment of the invention and previously discussed in detail it is not necessary for the operator to open such cover to replenish detergent. This virtually eliminates the risk of personal injury to the operator due to the splashing hazards often encountered with conventional cover constructions which to require opening for charging detergent. However, the present invention, according to less preferred embodiments thereof, includes the use of more conventional cover means. Accordingly the use of safety switch means is recommended in such embodiments. Such means are likewise described in U.S. Pat. No. 4,063,663 and referenced publications. Thus, by use of a mercury switch and included circuity, the previously mentioned solenoid valve operable in the water supply line to the inlet port 68 is closed whenever the cover 12 is removed from fully closed position thus preventing water flow to the inlet port 68. The solenoid valve remains closed even through an external signal from the afore-mentioned control module indicates demand for replenishment of the detergent reservoir in the washing machine. Water flow to the container 10 under such conditions is not possible until an appropriate signal from the mercury safety control switch indicating the cover 12 to be fully closed. In this sense, the safety switch means is dominant.

The advantages of the present invention are manifold Saturated solutions are assured due to the method of contacting solvent solution and detergent mass; intimacy and efficiency of contacting are significantly enhanced as is the contacting interval. This is particularly advantageous in the case of less soluble detergents. In operation, an equilibrium is established across the detergent mass based upon a concentration gradient. This can be manipulated for example by controlling the total mass of detergent used. The advantages normally characterizing a solvent extraction process are thus made available. In spray techniques wherein a water stream is caused in inpinge upon but a portion of the detergent mass, no such benefits are possible. Means for assuring saturated discharge detergent solutions are not provided according to such techniques and particularly to the case of less soluble detergents. Moreover, to be effective, relatively high pressure sprays must be used thereby increasing pumping requirements and thus cost. In the present invention, pressure requirements are minimal; the fluid pressure need only be that necessary to percolate the inlet water through the detergent mass.

The present invention is applicable to detergents in powder, flake, liquid, granule, pellet, paste-including thixotropic form. In all cases, the ratio of ingredients in the detergent composition is maintained relatively constant.

Although described with reference to a rigid perforated plate member, the invention is equally effective when such member is replaced by a rigid or flexible membrane, a plurality of perforated pipes, a perforated box, screen of adequate mesh and the like. In the case of perforated pipes, for example, inlet water may be fed directly thereto. The pipes may be positioned in such manner as to be substantially coterminous with bottom portion 16 thus eliminating any requirement for a significant reservoir portion.

In some instances it may be desirable to use a second apertured member disposed substantially horizontally between the outlet port 46 and the detergent retaining zone 60. Thus, should unanticipated surges in inlet water pressure occur, there is a danger that the detergent mass may be "fluidized" and under such conditions spill over into the outlet port 46. A second apertured member, positioned as described, provides effective means for mitigating such untoward effects.

This invention has been disclosed with respect to preferred embodiments, and various modifications and variations thereof obvious to those skilled in the art are intended to be included within the spirit and preview of this application and the scope of the appended claims.

We claim:

1. A container for providing water-added detergent solutions comprising top, bottom and connecting sidewall portions, said top portion being pivotally mounted to said sidewall portion for movement to open and closed positions, a support member disposed substantially horizontally within said container for receiving a plurality of apertures for distributing an aqueous medium upwardly of said member, said support member in combination with said sidewall portion defining a detergent retaining zone thereabove, water inlet means positioned to initiate low pressure percolating water flow upwardly through said apertures, outlet means positioned above said detergent retaining zone for discharging aqueous, solubilized detergent from said container and adapted to removably engage conduit means for external transport of said discharged liquid, switch control means responsive to movement of said top portion for blocking water flow to said container when said top portion is removed from a fully closed position and means for attaching said container to an external supporting surface.

2. A container according to claim 1 wherein said top portion is configured to provide a peripheral ledge portion for engaging said sidewall portion in closed position, said ledge portion being integral with a downwardly convergent central portion truncated to provide a slit type opening for charging detergent at said detergent retaining zone.

3. A container according to claim 2 wherein the angle of convergence of said central portion is about 35° to 55°.

4. A container according to claim 1 wherein said support member comprises a perforated plate.

5. A container according to claim 1 wherein said support member comprises a plurality of perforated pipes.

6. A container according to claim 1 wherein said support member comprises a rigid or flexible permeable membrane.

7. A container according to claim 1 wherein said support member comprises a continuous screen member.

8. A container according to claim 1 wherein said detergent retaining zone is divided into approximately co-equal sections by a plurality of vertically disposed baffle members supported by said support member and sidewall portion.

9. A container according to claim 1 wherein said apertures are circular in shape having an average diameter of about 0.5 to 2.75 mm.

10. A container according to claim 1 wherein said apertures are arranged in parallel along perpendicular axes, adjacent of said apertures being spaced apart by about 10 to 40 mm.

11. A container according to claim 1, said support member being provided with a pair of opposed, upwardly extending arms, configured in their uppermost portions to facilitate hand gripping enabling removal of said support member from said container.

12. A container according to claim 1 wherein said support member is spaced from said bottom portion by a vertical distance which is about 20 to 100% of the vertical extent of said detergent retaining zone.

13. A container according to claim 1 wherein said outlet means engages external conduit means in liquid flow communication with the detergent reservoir of a washing machine.

14. A container according to claim 13 wherein waterflow to said container through said inlet means is in response to the concentration level of detergent in said detergent reservoir and said switch control means responsive to movement of said top portion, said switch control means being dominant.

15. A container according to claim 1 wherein a second support member having a plurality of apertures is disposed substantially horizontally between said outlet means and said detergent retaining zone.

16. A container according to claim 1 having charged thereto a detergent material in powder, flake, liquid, granule, pellet or paste form.

17. A container according to claim 16 wherein said detergent is in the form of a thixotropic paste.

18. A container according to claim 1 wherein said water inlet means is located in said sidewall portion.

* * * * *